US011214852B2

(12) United States Patent
Schall et al.

(10) Patent No.: US 11,214,852 B2
(45) Date of Patent: Jan. 4, 2022

(54) ALLOYS FOR TURBOCHARGER COMPONENTS

(71) Applicant: BorgWarner Inc., Auburn Hills, MI (US)

(72) Inventors: Gerald Schall, Bobenheim (DE); Alexandra Ziegler, Alzey (DE)

(73) Assignee: BorgWarner Inc., Auburn Hills, MI (US)

( * ) Notice: Subject to any disclaimer, the term of this patent is extended or adjusted under 35 U.S.C. 154(b) by 167 days.

(21) Appl. No.: 16/484,529

(22) PCT Filed: Feb. 2, 2018

(86) PCT No.: PCT/US2018/016558

§ 371 (c)(1),
(2) Date: Aug. 8, 2019

(87) PCT Pub. No.: WO2018/148110

PCT Pub. Date: Aug. 16, 2018

(65) Prior Publication Data

US 2020/0010932 A1 Jan. 9, 2020

(30) Foreign Application Priority Data

Feb. 8, 2017 (EP) ..... 17155147

(51) Int. Cl.
*C22C 19/05* (2006.01)
*F01D 5/28* (2006.01)

(52) U.S. Cl.
CPC ..... *C22C 19/056* (2013.01); *F01D 5/28* (2013.01); *F05D 2220/40* (2013.01)

(58) Field of Classification Search
CPC ..... C22C 19/056; C22F 1/10
See application file for complete search history.

(56) References Cited

U.S. PATENT DOCUMENTS 4,063,939 A 12/1977 Weaver et al.
2014/0348689 A1* 11/2014 Hardy ..... C22C 19/056 419/29

FOREIGN PATENT DOCUMENTS

| | | | |
|---|---|---|---|
| CA | 967405 | A | 5/1975 |
| CN | 1045607 | A | 9/1990 |
| CN | 1076508 | A | 9/1993 |
| EP | 1462533 | A | 9/2004 |
| GB | 202180 | A | 3/1980 |
| RU | 2585148 | C1 | 5/2016 |
| WO | 2008072303 | A1 | 6/2008 |

OTHER PUBLICATIONS

Written Opinion and International Search Report dated Apr. 30, 2018, in International Application No. PCT/US2018/016558.
Chinese Office Action (with English language translation) dated Jan. 7, 2021, in Chinese Application No. 201880019832.4.

* cited by examiner

*Primary Examiner* — Jessee R Roe
(74) *Attorney, Agent, or Firm* — Eric L. Doyle; Stephen A. Pendorf; Patent Central LLC

(57) ABSTRACT

Turbocharger components comprising a relatively light-weight nicked-based superalloy having an amount of γ'-phase domains that is greater than 40% after aging the component at 1000° C. for 300 hours.

18 Claims, 2 Drawing Sheets

ALLOYS FOR TURBOCHARGER COMPONENTS

FIELD OF THE INVENTION

The present invention relates to the field of turbochargers, in particular turbochargers for use in internal combustion engines.

BACKGROUND OF THE INVENTION

Turbochargers are used to increase combustion air throughput and density, thereby increasing power and efficiency of internal combustion engines. The design and function of turbochargers are described in detail in the prior art, for example, U.S. Pat. Nos. 4,705,463, and 5,399,064, the disclosures of which are incorporated herein by reference. To meet fuel efficiency and emission requirements, modern passenger car gasoline engines place very high demands on the thermal load capacity of exhaust turbochargers. The temperature on the turbine inlet may reach up to about 1050° C. under steady-state engine conditions. The turbine wheel is the component of the turbocharger that is subjected to the highest performance requirements, because of its high mechanical load in addition to the high temperature.

Presently, in particular MAR M 247 is used/contemplated for such demanding turbocharger components. However, MAR M 247 contains 1.5 wt.-% Hf and is, thus, very expensive. Alternatively, it would be possible to use aerospace-grade Re-containing Ni-based super alloys. However, these alloys are also too expensive for the automotive industry.

It would be desirable to replace expensive alloys such as Mar M 247 with a more cost efficient alloy of similar performance in turbocharger applications.

SUMMARY OF THE INVENTION

It has now been surprisingly found that the above objective can be solved by the provision of a nickel-based super alloy that has a relative low density of less than 8.35 g/cm$^3$ at room temperature. Specimen of these alloys can be expected to have excellent TMF, LCF, and creep performance at the intended operating temperatures of 1000° C. to 1050° C. While the TMF and LCF performance of the alloy's test specimen may be slightly inferior to that of e.g. MAR M 247, the performance of the actual work piece can be expected to be substantially equivalent to that of alloys such as MAR M 247 due to lower density: A turbocharger wheel rotates at up to about 280,000 rpm and is permanently subjected to accelerating and decelerating forces as well as centrifugal forces. These forces and, thus, also the induced stresses are dependent on the mass of the turbocharger blades. Using a blade that is made of a more light-weight alloy reduces the stress on the blade and increases TMF and LCF performance of the turbine wheel. Thus, both inherent TMF and LCF performance of the alloy and its lower density jointly contribute to increasing the overall performance and life time of the turbine wheel.

Moreover, the alloys of the present invention are characterized by sufficient oxidation and corrosion resistance and excellent resistance against thermal fatigue. At the same time, these benefits are realized with an alloy that is very cost effective since it does not rely on larger amounts of expensive elements such as hafnium and rhenium. Finally, the alloy can be expected to have good workability due to the relatively low cobalt content.

In a first aspect, the present invention relates to turbo charger component, in particular a turbine wheel for an internal combustion engine, comprising a polycrystalline nickel-based alloy of the following composition:

| | |
|---|---|
| Cr | 10.0 to 15.0 wt.-%; |
| Co | 4.0 to 9.0 wt.-%; |
| C | 0.05 to 0.15 wt.-%; |

Al, Ti, Nb, and Ta in a total amount of 7.0 to 15.0 wt. %, with the proviso that the amount of Al is at least 3.7 wt.-%, the amount of the γ'-phase is greater than 40% after aging the component at 1000° C. for 300 hours; Mo and W in a total amount of 2.0 to 5.0 wt.-%, wherein Mo and W are present in the weight ratio of Mo:W=0.7 to 1.8;

optionally Re and Hf with the proviso that each element is present in an amount of less than 1 wt.-%;

optionally other elements in a total amount of less than 3 wt.-% (impurities), in particular, independently from each other, Fe, Mn, P, S, and Si in amounts of less than 0.05 wt.-%; and Ni as balance.

In a second aspect of the invention, there is provided a turbo charger component, in particular a turbine wheel for an internal combustion engine, comprising a polycrystalline nickel-based alloy of the following composition:

| | |
|---|---|
| Cr | 10.0 to 15.0 wt.-%; |
| Co | 4.0 to 9.0 wt.-%; |
| C | 0.05 to 0.15 wt.-%; |
| Al | 4.0 to 5.5 wt.-%; |
| Ta | 1.2 to 2.4 wt. %; |
| Nb | 0.3 to 1.5 wt.-%; |
| Mo | 1.3 to 2.3 wt.-%; |
| W | 0.9 to 2.1 wt.-%; |
| Ti | 2.4 to 3.5 wt.-%; |

optionally Re and Hf with the proviso that each element is present in an amount of less than 1 wt.-%;

optionally other elements in a total amount of less than 3 wt.-% (impurities), in particular, independently from each other, Fe, Mn, P, S, and Si in amounts of less than 0.05 wt.-%; and Ni as balance.

DETAILED DESCRIPTION OF THE INVENTION

Figure 1:
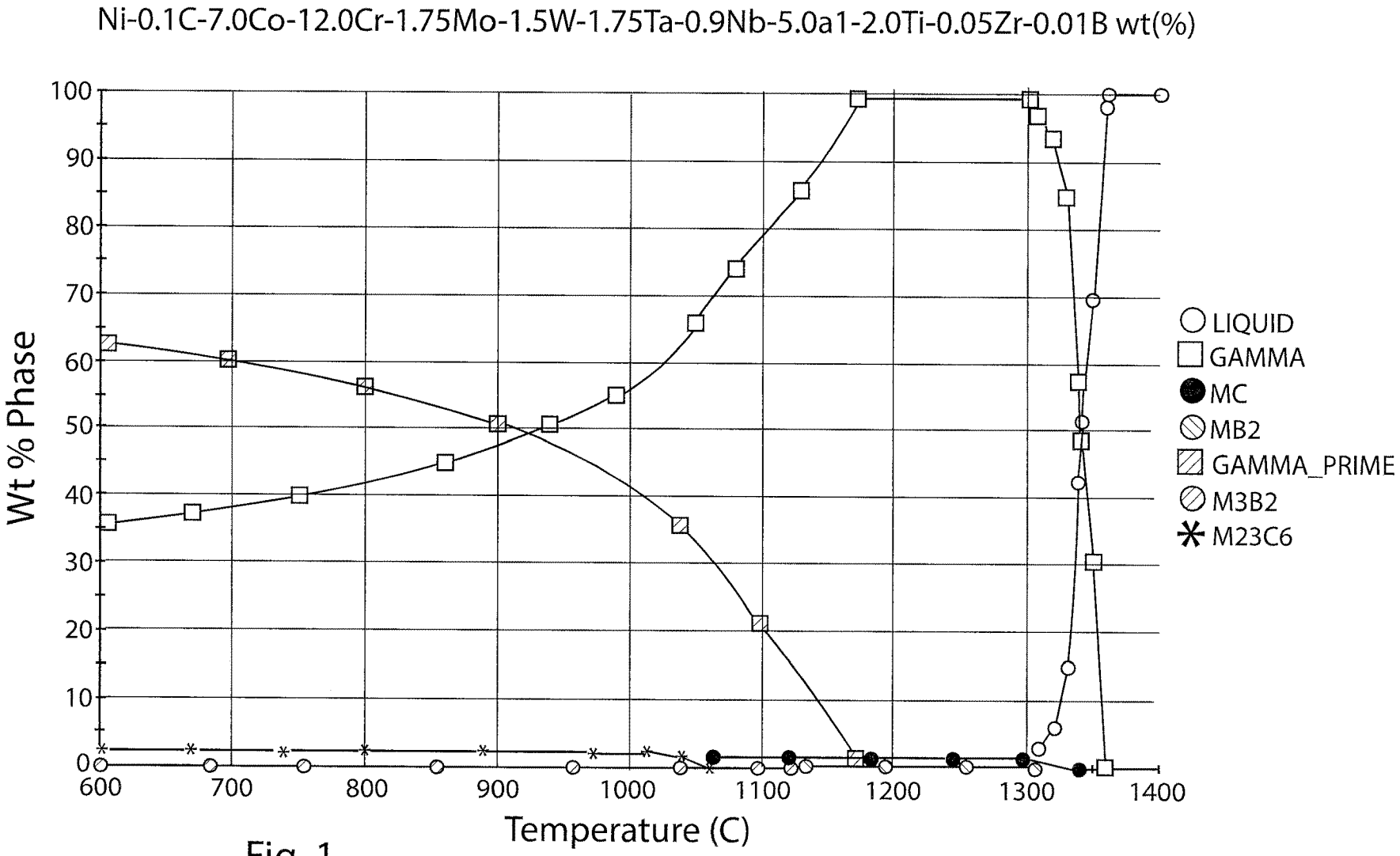
FIG. 1 shows a calculation of the weight percentage of the γ'-phase for an exemplary alloy of the invention.

In a first aspect, the present invention relates to turbo charger component, in particular a turbine wheel for an internal combustion engine, comprising a polycrystalline nickel-based alloy of the following composition:

| | |
|---|---|
| Cr | 10.0 to 15.0 wt.-%; |
| Co | 4.0 to 9.0 wt.-%; |
| C | 0.05 to 0.15 wt.-%; |

Al, Ti, Nb, and Ta in a total amount of 7.0 to 15.0 wt.-%, with the proviso that the amount of Al is at least 3.7 wt.-%, the amount of the γ'-phase is greater than 40% after aging the component at 1000° C. for 300 hours; Mo and W in a total amount of 2.0 to 5.0 wt.-%, wherein Mo and W are present in the weight ratio of Mo:W=0.7 to 1.8;

optionally Re and Hf with the proviso that each element is present in an amount of less than 1 wt.-%;

optionally other elements in a total amount of less than 3 wt.-% (impurities), in particular, independently from each other, Fe, Mn, P, S, and Si in amounts of less than 0.05 wt.-%; and Ni as balance.

The above alloy is a Ni-based alloy that contains Cr as one of its main alloying elements. Cr is an element indispensable for heightening oxidation resistance and contributes to the high temperature strength of the alloy. The alloy further contains at least 3.7 wt.-% Al to facilitate the formation of aluminum oxides on the surface of the turbocharger component. These oxides further increase the oxidation resistance of the turbocharger component by passivation.

Al is also important for the generation of the γ'-phase in combination with Ti, Nb, and Ta. The γ'phase is a second phase precipitate within the fcc austenitic Ni matrix and is formally composed of $Ni_3(Al,X)$ with X=Ti, Nb or Ta. The proportion of the γ'-phase i.a. correlates to the amount of γ'-forming elements, in particular to aluminum. In the present invention, a total amount of 7.0 to 15.0 wt.-% of Al, Ti, Nb and Ta can be used to create a morphology wherein the proportion of the γ'-phase is greater than 40% after aging the component at 1000° C. for 300 hours.

The amount (in the following also referred to as proportion) of the γ'-phase can be routinely determined for any given alloy. An exemplary method is an optical analysis, including preparing a metallographic section, with polishing and/or etching the cut surface of the specimen, obtaining a microphotography of the metallographic section, determining the area of a representative number of typically cuboidal γ'-phase domains, either manually or using automated image analysis, and relating that value to the total analyzed area. In this context, a representative number of domains may be considered to be the number of γ'-phase domains in one or more grains, typically 3 to 5 grains. In that case, the total analyzed area would be the total area of the grain. Alternatively, a representative number of domains may be considered to be at least 100 γ'-phase domains, with the amount of the γ'-phase in this case being the area of all γ'-phase domains in a given analyzed area in relation to said analyzed area. The obtained percentage is an area-percentage, but is representative for the volume (or weight) fraction of the γ'-phase in the alloy.

The γ'-phase acts as a barrier to dislocation motion through the fcc Ni matrix and, thus, a high proportion of the γ'-phase is beneficial for obtaining high temperature creep resistance and strength. A proportion of the γ'-phase of greater than 40% at 1000° C. is considered to provide a balanced mix of high temperature strengthening, castability and workability.

In the range of a total amount of Al, Ti, Nb and Ta of 7.0 to 15.0 wt.-%, the skilled person can routinely estimate/determine the resulting proportion of the γ'-phase at 1000° C. It is also possible to additionally rely on computed models, as shown in FIG. 1. FIG. 1 shows the computed weight percentage of the γ'-phase in relation to temperature for an exemplary alloy according to the invention. FIG. 1 was calculated using the software JMatPro, obtainable from Sente Software Ltd., Guildford, UK. Further information on the prediction of the proportion of γ'-phase using JMatPro can be found in Modelling High Temperature Mechanical Properties and Microstructure Evolution in Ni-based Superalloys by N. Saunders, Z. Guo, A. P. Miodownik and J-Ph. Schillé, published by Sente Software Ltd. (available on: http://www.sentesoftware.co.uk/media/2485/ni-superalloys-2008.pdf), which is incorporated herein by reference.

Furthermore, the alloys of the present invention are stabilized at the grain boundaries to further improve LCF performance and strength. Several options exist for stabilizing the grain boundaries, but the alloys of the present invention are stabilized by precipitation of carbides. Carbides tend to accumulate at the grain boundaries. However, care has to be taken to avoid an excessive amount of carbides in the fcc Ni matrix which may participate in fatigue cracking and, thus, reduce in particular LCF performance. Furthermore, carbides at the grain boundaries are more effective in increasing the strength of the alloy than carbides randomly dispersed in the matrix. Therefore, the alloys of the present invention are required to have a low carbon content of 0.05 to 0.15 wt.-% C, to facilitate the formation of carbides at the grain boundaries and to minimize the negative effects associated with presence of carbides in the matrix.

The elements Nb, Ta, Mo and W can form primary carbides MC as well as secondary carbides such as $MC_6$ and $M_{23}C_6$. As indicated in M. J. Donachie, S. J. Donachie, Superalloys: A Technical Guide, $2^{nd}$ ed., 2002, pages 510-512, carbides of the type MC tend to be unstable in Ni-based superalloys and tend to decompose into $M_6C$ in the range of 980 to 1040° C., if the alloy contains a sufficiently high amount of Mo and W. The reason for this is that the refractory elements Mo and W preferentially form carbides with Ni, Co and Cr. Exemplary carbides are $(Ni,Co)_3Mo_3C$ and $(Ni,Co)_2W_4C$. The $M_6C$ carbides may also convert to the closely related but more stable $M_{12}C$ carbides at 760 to 980° C., in particular $M_{12}C$ carbides wherein M=Mo or W. Without wishing to be bound by theory, it is believed that the presence of secondary carbides is particularly effective in stabilizing the grain boundaries such that excessive grain coarsening is avoided. Since coarser grains increase crack growth rates, the LCF performance is equally improved. Therefore, Mo and W are used in a total amount of 2.0 to 5.0 wt.-%. The exact ratio of Mo to W is not critical, however, it is convenient to use a weight ratio of Mo:W of 0.7 to 1.8 to obtain a balanced mix of secondary effects, specifically solid solution strengthening of the alloy and adjusting its high temperature creep performance.

The alloys of the present invention further contain Co. Co solid-dissolves in the fcc Ni matrix and improves in particular creep strength. Moreover, Co also forms carbides such as $(Ni,Co)_3Mo_3C$ and $(Ni,Co)_2W_4C$. Thus, the formation of $M_6C$ carbides is also facilitated by the presence of 4.0 to 9.0 wt.-% Co. Finally, Co also helps in avoiding the depletion of Cr due to excessive chromium carbide formation. An excessive Cr depletion could result in insufficient chromium oxide formation and reduced oxidation and corrosion resistance.

The alloys of the present invention are further relatively inexpensive since they avoid the use of expensive elements such as Re and Hf in larger amounts. More specifically, Re and Hf (if present) are each used in an amount of less than 1 wt.-%.

Besides the above-mentioned elements, the alloy may also contain other elements in minor amounts which add up to a total amount of less than 3 wt.-%, more specifically less than 2 wt.-%, in particular less than 1 wt.-%. These other elements will typically be impurities introduced from raw materials or during the preparation of the alloy. Examples include Fe, Mn, P, S, and Si which advantageously are each, independently from each other, present in amounts of less than 0.05 wt.-%. However, other elements purposefully added in minor amounts to fine-tune alloy properties are also intended to be included in this definition as long as their total amount, together with the total amount of the aforementioned impurities, is less than 3 wt.-%. Examples of elements which may be purposefully added in minor amounts to fine-tune alloy properties include B, Zr, and Y. These are typically added in very low amounts (<0.01 wt.-%) for grain boundary strengthening (B and Zr) or for improving adhesion of the oxide passivation layer (Zr and Y).

In view of optimizing the performance of the alloy, embodiments of the invention may further comprise one of the following features or any combination of the following features:

The alloy may contain 1.2 to 2.4 wt. % Ta, in particular 1.5 to 2.0 wt.-% Ta.

The alloy may contain 0.3 to 1.5 wt.-% Nb, in particular 0.6 to 1.1 wt.-% Nb.

The alloy may contain 4.0 to 5.5 wt.-% Al, in particular 4.3 to 5.1 wt.-% Al.

The amount of Re and Hf in the alloy may be independently from each other less than 0.15 wt.-%, in particular less than 0.1 wt.-%.

The weight ratio of Al to Ti in the alloy may be in the range of 1.1 to 1.9, or 1.3 to 1.8, and in particular 1.35 to 1.65.

The alloy may contain 2.4 to 3.5 wt.-% Ti, in particular 2.7 to 3.2 wt.-% Ti.

The alloy may contain 11.0 to 13.0 wt.-% Cr, in particular 11.7 to 12.3 wt.-% Cr.

The alloy may contain 6.0 to 8.0 wt.-% Co, in particular 6.7 to 7.3 wt.-% Co.

The alloy may contain a total amount of W and Mo of 2.0 to 5.0 wt.-%, in particular 2.5 to 4.5 wt.-%.

The weight ratio of Mo to W may be in the range of 0.9 to 1.5, in particular 1.1 to 1.3.

The alloy may contain 1.3 to 2.3 wt.-% Mo, in particular 1.5 to 2.0 wt.-% Mo.

The alloy may contain 0.9 to 2.1 wt.-% W, in particular 1.2 to 1.8 wt.-% W.

The alloy may contain 0.06 to 0.14 wt.-% C, in particular 0.08 to 0.12 wt.-% C.

The alloy may contain a total amount of Al and Ti is in the range of 6.5 to 8.5 wt.-%, in particular 7.0 to 8.0 wt.-%.

Most advantageously, the alloy may contain 1.2 to 2.4 wt. % Ta, in particular 1.5 to 2.0 wt.-% Ta; and 0.3 to 1.5 wt.-% Nb, in particular 0.6 to 1.1 wt.-% Nb.

Most advantageously, the alloy may contain 4.0 to 5.5 wt.-% Al, in particular 4.3 to 5.1 wt.-% Al; and the weight ratio of Al to Ti in the alloy may be in the range of 1.1 to 1.9, or 1.3 to 1.8, and in particular 1.35 to 1.65.

Most advantageously, the alloy may contain 1.3 to 2.3 wt.-% Mo, in particular 1.5 to 2.0 wt.-% Mo; 0.9 to 2.1 wt.-% W, in particular 1.2 to 1.8 wt.-% W; and 2.4 to 3.5 wt.-% Ti, in particular 2.7 to 3.2 wt.-% Ti.

Most advantageously, the alloy may contain 1.2 to 2.4 wt. % Ta, in particular 1.5 to 2.0 wt.-% Ta; 0.3 to 1.5 wt.-% Nb, in particular 0.6 to 1.1 wt.-% Nb; and a total amount of Al and Ti is in the range of 6.5 to 8.5 wt.-%, in particular 7.0 to 8.0 wt.-%.

Most advantageously, the amount of the γ'-phase may be greater than 42%, in particular greater than 45%, after aging the component at 1000° C. for 300 hours. Alternatively, the amount of the γ'-phase may be in the range of between 40% and 65%, more specifically in the range of between 42% and 60%, and in particular between 45% and 55%, after aging the component at 1000° C. for 300 hours.

Most advantageously, the alloy may contain 1.2 to 2.4 wt. % Ta, in particular 1.5 to 2.0 wt.-% Ta; 0.3 to 1.5 wt.-% Nb, in particular 0.6 to 1.1 wt.-% Nb; and 4.0 to 5.5 wt.-% Al, in particular 4.3 to 5.1 wt.-% Al.

Most advantageously, the alloy may contain 2.4 to 3.5 wt.-% Ti, in particular 2.7 to 3.2 wt.-% Ti, and the weight ratio of Al to Ti in the alloy may be in the range of 1.1 to 1.9, or 1.3 to 1.8, and in particular 1.35 to 1.65.

Most advantageously, the alloy may contain a total amount of W and Mo of 2.0 to 5.0 wt.-%, in particular 2.5 to 4.5 wt.-%; and the weight ratio of Mo to W may be in the range of 0.9 to 1.5, in particular 1.1 to 1.3.

Most advantageously, the alloy may contain 11.0 to 13.0 wt.-% Cr, in particular 11.7 to 12.3 wt.-% Cr; and 6.0 to 8.0 wt.-% Co, in particular 6.7 to 7.3 wt.-% Co.

Most advantageously, the alloy may contain 1.3 to 2.3 wt.-% Mo, in particular 1.5 to 2.0 wt.-% Mo; and 0.9 to 2.1 wt.-% W, in particular 1.2 to 1.8 wt.-% W.

Most advantageously, the alloy may contain 1.2 to 2.4 wt. % Ta, in particular 1.5 to 2.0 wt.-% Ta; 0.3 to 1.5 wt.-% Nb, in particular 0.6 to 1.1 wt.-% Nb; and 4.0 to 5.5 wt.-% Al, in particular 4.3 to 5.1 wt.-% Al; and 0.06 to 0.14 wt.-% C, in particular 0.08 to 0.12 wt.-% C.

In a second aspect of the invention, there is provided a turbo charger component, in particular a turbine wheel for an internal combustion engine, comprising a polycrystalline nickel-based alloy of the following composition:

| | |
|---|---|
| Cr | 10.0 to 15.0 wt.-% |
| Co | 4.0 to 9.0 wt.-%; |
| C | 0.05 to 0.15 wt.-%; |
| Al | 4.0 to 5.5 wt.-%; |
| Ta | 1.2 to 2.4 wt. %; |
| Nb | 0.3 to 1.5 wt.-%; |
| Mo | 1.3 to 2.3 wt.-%; |
| W | 0.9 to 2.1 wt.-%; |
| Ti | 2.4 to 3.5 wt.-%; |

optionally Re and Hf with the proviso that each element is present in an amount of less than 1 wt.-%;

optionally other elements in a total amount of less than 3 wt.-% (impurities), in particular, independently from each other, Fe, Mn, P, S, and Si in amounts of less than 0.05 wt.-%; and Ni as balance.

According to this aspect of the invention, it may be advantageous that the alloy further comprises one or any combination of the following features:

The alloy may contain 0.06 to 0.14 wt.-% C, in particular 0.08 to 0.12 wt.-% C.

The alloy may contain a total amount of Al and Ti is in the range of 6.5 to 8.5 wt.-%, in particular 7.0 to 8.0 wt.-%.

Most advantageously, the alloy may contain 1.5 to 2.0 wt.-% Ta; and 0.6 to 1.1 wt.-% Nb.

Most advantageously, the alloy may contain 4.3 to 5.1 wt.-% Al.

Most advantageously, the alloy may contain 1.5 to 2.0 wt.-% Mo; 1.2 to 1.8 wt.-% W; and 2.7 to 3.2 wt.-% Ti.

Most advantageously, the alloy may contain 1.2 to 2.4 wt. % Ta, in particular 1.5 to 2.0 wt.-% Ta; 0.3 to 1.5 wt.-% Nb, in particular 0.6 to 1.1 wt.-% Nb; and a total amount of Al and Ti is in the range of 7.0 to 8.0 wt.-%.

Most advantageously, the alloy may contain 1.2 to 2.4 wt. % Ta, in particular 1.5 to 2.0 wt.-% Ta; 0.3 to 1.5 wt.-% Nb, in particular 0.6 to 1.1 wt.-% Nb; and 4.0 to 5.5 wt.-% Al, in particular 4.3 to 5.1 wt.-% Al.

Most advantageously, the alloy may contain 2.4 to 3.5 wt.-% Ti, in particular 2.7 to 3.2 wt.-% Ti, and the weight ratio of Al to Ti in the alloy may be in the range of 1.1 to 1.9, or 1.3 to 1.8, and in particular 1.35 to 1.65.

Most advantageously, the alloy may contain a total amount of W and Mo of 2.0 to 5.0 wt.-%, in particular 2.5 to 4.5 wt.-%; and the weight ratio of Mo to W may be in the range of 0.9 to 1.5, in particular 1.1 to 1.3.

Most advantageously, the alloy may contain 11.0 to 13.0 wt.-% Cr, in particular 11.7 to 12.3 wt.-% Cr; and 6.0 to 8.0 wt.-% Co, in particular 6.7 to 7.3 wt.-% Co.

Most advantageously, the alloy may contain 1.3 to 2.3 wt.-% Mo, in particular 1.5 to 2.0 wt.-% Mo; and 0.9 to 2.1 wt.-% W, in particular 1.2 to 1.8 wt.-% W.

Most advantageously, the alloy may contain 1.2 to 2.4 wt. % Ta, in particular 1.5 to 2.0 wt.-% Ta; 0.3 to 1.5 wt.-% Nb, in particular 0.6 to 1.1 wt.-% Nb; and 4.0 to 5.5 wt.-% Al, in particular 4.3 to 5.1 wt.-% Al; and 0.06 to 0.14 wt.-% C, in particular 0.08 to 0.12 wt.-% C.

Most advantageously, the amount of the γ'-phase in the alloy of the turbocharger component may be greater than 20%, more specifically greater than 42%, in particular greater than 45%, after aging the component at 1000° C. for 300 hours. Alternatively, the amount of the γ'-phase may be in the range of between 40% and 65%, more specifically in the range of between 42% and 60%, and in particular between 45% and 55%, after aging the component at 1000° C. for 300 hours. The definition of the amount of γ'-phase is as for the first aspect of the invention.

Regarding the turbocharger components preparable from the alloys of both aspects of the invention, and referring to a "as sold" turbocharger component, i.e. a turbocharger component not yet subjected to any substantial period of exposure to heat aging under service conditions, the average size of the γ'-phase may advantageously be less than 1.0 μm, in particular less than 0.7 μm, and in particular less than 0.5 μm. Alternatively, the average size of the γ'-phase may advantageously be in the range of 0.1 to 1.0 μm, more specifically in the range of 0.2 to 0.6 μm, and in particular in the range of 0.25 to 0.50 μm.

The average grain size may be determined using an optical analysis, including preparing a metallographic section, optionally with polishing and/or etching the cut surface of the specimen, obtaining a microphotography of the metallographic section, determining the average grain size of a representative number of typically cuboidal γ'-phase domains, either manually or using automated image analysis. In this context, a representative number of domains may be considered to be the number of γ'-phase domains in one or more grains, typically 3 to 5 grains. Alternatively, a representative number of domains may be considered to be at least 100 γ'-phase domains.

Advantageously, the density of the alloy according to the present invention may be less 8.35 g/cm$^3$, more specifically less than 8.30 g/cm$^3$, in particular less than 8.25 g/cm$^3$, at room temperature. Alternatively, the alloy according to the present invention may have a density in the range of 7.70 to 8.35 g/cm$^3$, more specifically 7.80 to 8.30 g/cm$^3$, in particular 7.90 to 8.25 g/cm$^3$.

The above discussed alloys provide a very balanced mix of properties, including low fatigue after periodic cycling of thermal stresses, excellent LCF and TMF performance, and resistance to oxidation and corrosion in the presence of exhaust gases. Therefore, these alloys are very suitable for use as turbocharger components, in particular turbine wheels for an internal combustion engine.

Moreover, the alloy properties do not excessively deteriorate under service conditions. For instance, grain coarsening of the γ'-phase at high temperatures is a well-known phenomenon of nickel-based superalloys which deteriorates the mechanical properties of the alloy. The alloys of the present invention can be expected to perform well in this respect, with a coarsening of the γ'-phase of less than 600%, advantageously less than 450% and in particular less than 300%, after exposure to 1000° C. for 500 hours.

Grain coarsening may be determined by comparing the average grain size of the γ'-phase before and after exposing a test specimen of the alloy to service-like conditions, such as 1000° C. for 500 hours. The average size of the γ'-phase may be determined using the above-referenced methods.

Methods of preparing the above-mentioned alloys as well as the respective turbocharger components of the invention are known in the art.

Figure 2:
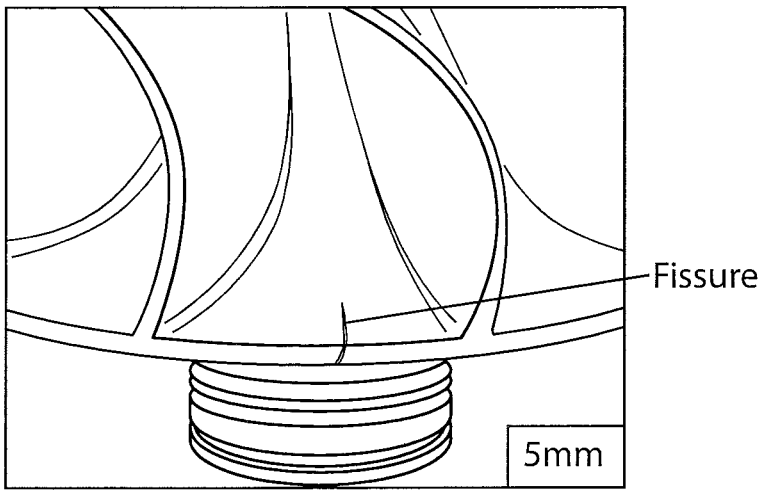
FIG. 2 shows a thermos-fatigued turbocharger wheel after exposure to cyclic thermo-loading.

Methods of analyzing TMF, LCF and TF performance are established in the art. Analysis of the TF performance may for exemplary be done by cyclic thermo-loading of the turbocharger component by inductive heating and air cooling, for instance using a cycle of the following steps: heating the turbocharger component with a heating rate of 20K/sec up to a temperature of 950° C., holding said temperature for 60 sec, and fan-assisted air cooling to 200° C. The temperature of the turbocharger component may be controlled by using a pyrometer. Thermal fatigue may be determined after thermo-loading cycles by checking for fissures, as shown in FIG. 2 for a turbocharger wheel.

Still further embodiments are within the scope of the following claims.

The invention claimed is:

1. A turbocharger component, comprising a polycrystalline nickel-based alloy of the following composition:

| | |
|---|---|
| Cr | 10.0 to 15.0 wt.-%; |
| Co | 4.0 to 9.0 wt.-%; |
| C | 0.05 to 0.15 wt.-%; |

Al, Ti, Nb, and Ta in a total amount of 7.0 to 15.0 wt. %, with the proviso that the amount of Al is at least 3.7 wt.-%, the amount of the γ'-phase is greater than 40% after aging the component at 1000° C. for 300 hours;

Mo and W in a total amount of 2.0 to 5.0 wt.-%, wherein Mo and W are present in the weight ratio of Mo:W=0.7 to 1.8;

optionally Re and Hf with the proviso that each element is present in an amount of less than 1 wt.-%;

optionally other elements in a total amount of less than 3 wt.-% (impurities), independently from each other, Fe, Mn, P, S, and Si in amounts of less than 0.05 wt.-%; and Ni as balance, wherein the average size of the γ'-phase is less than 1.0 μm and the density of the component is less than 8.35 g/cm$^3$.

2. The turbocharger component according to claim 1, wherein the alloy contains 1.2 to 2.4 wt. % Ta.

3. The turbocharger component according to claim 1, wherein the alloy contains 0.3 to 1.5 wt.-% Nb.

4. The turbocharger component according to claim 1, wherein the alloy contains 4.0 to 5.5 wt.-% Al.

5. The turbocharger component according to claim 1, wherein the amount of Re and Hf is independently from each other less than 0.15 wt.-%.

6. The turbocharger component according to claim 1, wherein the weight ratio of Al to Ti is in the range of 1.1 to 1.9, or 1.3 to 1.8.

7. The turbocharger component according to claim 1, wherein the alloy contains 2.4 to 3.5 wt.-% Ti.

8. The turbocharger component according to claim 1, wherein the alloy contains 11.0 to 13.0 wt.-% Cr.

9. The turbocharger component according to claim 1, wherein the alloy contains 6.0 to 8.0 wt.-% Co.

10. The turbocharger component according to claim 1, wherein the total amount of W and Mo is 2.0 to 5.0 wt.-% and the weight ratio of Mo to W is in the range of 0.9 to 1.5.

11. The turbocharger component according to claim 1, wherein the alloy contains at least one of 1.3 to 2.3 wt.-% Mo and 0.9 to 2.1 wt.-% W.

12. The turbocharger component according to claim 1, wherein the alloy contains 0.06 to 0.14 wt.-% C.

13. The turbocharger component according to claim 1, wherein the total amount of Al and Ti is in the range of 6.5 to 8.5 wt.-%.

14. The turbocharger component according to claim 1, wherein the alloy contains 1.5 to 2.0 wt.-% Ta.

15. The turbocharger component according to claim 1, wherein the alloy contains 0.6 to 1.1 wt.-% Nb.

16. The turbocharger component according to claim 1, wherein the alloy contains 4.3 to 5.1 wt.-% Al.

17. The turbocharger component according to claim 1, wherein the alloy contains 2.7 to 3.2 wt.-% Ti.

18. A turbocharger component, comprising a polycrystalline nickel-based alloy of the following composition:

| | |
|---|---|
| Cr | 10.0 to 15.0 wt.-%; |
| Co | 4.0 to 9.0 wt.-%; |
| C | 0.05 to t 0.15 wt.-%; |

Al, Ti, Nb, and Ta in a total amount of 7.0 to 15.0 wt. %, with the proviso that the amount of Al is at least 3.7 wt.-%, the amount of the γ'-phase is greater than 40% after aging the component at 1000° C. for 300 hours;

Mo and W in a total amount of 2.0 to 5.0 wt.-%, wherein Mo and W are present in the weight ratio of Mo:W=0.7 to 1.8;

optionally Re and Hf with the proviso that each element is present in an amount of less than 1 wt.-%;

optionally other elements in a total amount of less than 3 wt.-% (impurities), independently from each other, Fe, Mn, P, S, and Si in amounts of less than 0.05 wt.-%; and Ni as balance, wherein said turbocharger component is a turbine wheel for an internal combustion engine.

* * * * *